US007514394B2

(12) United States Patent
Kodali et al.

(10) Patent No.: US 7,514,394 B2
(45) Date of Patent: Apr. 7, 2009

(54) OILS WITH HETEROGENOUS CHAIN LENGTHS

(75) Inventors: Dharma R. Kodali, Plymouth, MN (US); Scott C. Nivens, New Hope, MN (US)

(73) Assignee: Cargill, Incorporated, Wayzata, MN (US)

( * ) Notice: Subject to any disclaimer, the term of this patent is extended or adjusted under 35 U.S.C. 154(b) by 335 days.

(21) Appl. No.: 11/072,071

(22) Filed: Mar. 4, 2005

(65) Prior Publication Data

US 2005/0176597 A1 Aug. 11, 2005

Related U.S. Application Data

(60) Division of application No. 10/253,742, filed on Sep. 24, 2002, now Pat. No. 6,943,262, which is a continuation of application No. 09/487,700, filed on Jan. 19, 2000, now Pat. No. 6,465,401, which is a continuation-in-part of application No. 09/233,617, filed on Jan. 19, 1999, now Pat. No. 6,278,006.

(51) Int. Cl.
*C10M 101/04* (2006.01)
*C10M 105/38* (2006.01)

(52) U.S. Cl. ..... 508/486; 508/485

(58) Field of Classification Search ..... 508/486, 508/496

See application file for complete search history.

(56) References Cited

U.S. PATENT DOCUMENTS 4,144,183 A 3/1979 Koch et al.
4,243,540 A 1/1981 Mancini et al.
4,448,700 A 5/1984 Lankamp
4,627,192 A 12/1986 Fick
4,783,274 A 11/1988 Jokinen et al.
4,832,975 A 5/1989 Yang
5,021,179 A 6/1991 Zehler et al.
5,240,630 A 8/1993 Sabahi et al.
5,258,197 A 11/1993 Wheeler et al.
5,282,989 A 2/1994 Erickson et al.
5,290,465 A 3/1994 Sabahi
5,320,764 A * 6/1994 Camenzind et al. ..... 508/430
5,322,633 A 6/1994 Senaratne et al.
5,346,724 A 9/1994 Ohgake et al.
5,391,312 A 2/1995 Senaratne et al.
5,399,279 A 3/1995 Sabahi et al.
5,413,725 A 5/1995 Lal et al.

(Continued)

FOREIGN PATENT DOCUMENTS

DE 1 444 851 11/1968

(Continued)

OTHER PUBLICATIONS

Bailey's Industrial Oil and Fat Products, Y.H. Hui, editor, John Wiley & Sons, 5th ed. vol. 2, 1996, p. 112-113.*

(Continued)

*Primary Examiner*—Glenn Caldarola
*Assistant Examiner*—Jim Goloboy
(74) *Attorney, Agent, or Firm*—Fish & Richardson P.C.

(57) ABSTRACT

Oils containing a triacylglycerol polyol ester and a non-glycerol polyol ester are described, as well as methods of making such oils. Methods for improving lubrication properties of a vegetable oil also are described.

12 Claims, 7 Drawing Sheets

U.S. PATENT DOCUMENTS

| | | | | |
|---|---|---|---|---|
| 5,432,152 | A | 7/1995 | Dawson et al. | |
| 5,451,334 | A | 9/1995 | Bongardt et al. | |
| 5,470,497 | A | 11/1995 | Schlosberg et al. | |
| 5,538,661 | A | 7/1996 | Dawson et al. | |
| 5,549,836 | A | 8/1996 | Moses | |
| 5,589,217 | A | 12/1996 | Mazurek | |
| 5,599,574 | A * | 2/1997 | Guskey et al. | 426/660 |
| 5,614,648 | A * | 3/1997 | Greene et al. | 554/4 |
| 5,648,018 | A | 7/1997 | Sabahi | |
| 5,683,618 | A | 11/1997 | Sabahi | |
| 5,686,131 | A | 11/1997 | Sato et al. | |
| 5,716,916 | A | 2/1998 | Shiokawa et al. | |
| 5,721,199 | A | 2/1998 | Moses | |
| 5,747,434 | A * | 5/1998 | Lamsa et al. | 508/485 |
| 5,767,338 | A | 6/1998 | Fan | |
| 5,773,391 | A | 6/1998 | Lawate et al. | |
| 5,861,187 | A | 1/1999 | Debonte et al. | |
| 6,074,995 | A * | 6/2000 | Dohner | 508/460 |
| 6,127,324 | A | 10/2000 | Tolfa et al. | |
| 6,278,006 | B1 * | 8/2001 | Kodali et al. | 554/30 |

FOREIGN PATENT DOCUMENTS

| | | |
|---|---|---|
| EP | 0 322 027 | 5/1993 |
| EP | 0 435 253 | 3/1994 |
| EP | 0 406 479 | 4/1994 |
| EP | 0 698 078 | 8/1997 |
| EP | 0 843 000 | 10/2002 |
| JP | 311192 | 12/1989 |
| WO | WO 9210105 A1 * | 6/1992 |
| WO | WO 93/07240 | 4/1993 |
| WO | WO 96/07632 | 3/1996 |
| WO | WO 97/40698 | 11/1997 |
| WO | WO 98/07679 | 2/1998 |
| WO | WO 98/07680 | 2/1998 |

OTHER PUBLICATIONS

Asadauskas et al., "Oxidative Stability and Antiwear Properties of High Oleic Vegetable Oils," *Lubrication Engineering*, 1996, 52(12):877-882.

Cvitkovic et al., "A Thin-Film Test for Measurement of the Oxidation and Evaporation of Ester-Type Lubricants," *ASLE Transactions*, 1979, 22(4):395-401.

Kodali et al., "Molecular Packing of 1,2-Dipalmitoyl-3-decanoyl-sn-glycerol (PP10): Bilayer, Trilayer, and Hexalayer Structures," *J. Phys. Chem.*, 1989, 93:4683-4691.

Kodali et al., "Polymorphic behavior of 1,2-dipalmityol-3-lauroyl(PP12)-and 3-myristoy(PP14)-sn-glycerols," *J. Lipid Research*, 1990, 31:1853-1864.

Kodali et al., "Synthesis and Polymorphism of 1,2-Dipalmitoyl-3-acyl-sn-glycerols," *J. Am. Oil Chem. Soc.*, 1984, 61(6):1078-1084.

McVetty et al., "Neptune high erucic acid, low glucosinolate summer rape," *Can. J. Plant Sci.*, 1996, 76(2):343-344.

McVetty et al., "Venus high erucic acid, low glucosinolate summer rape," *Can. J. Plant Sci.*, 1996, 76(2):341-342.

Nutiu et al., "Correlations Between Structure and Physical and Rheological Properties in the Class of Neopentanepolyol Esters Used as Lubricating Oils," *Proc. Conf. Synth. Lubr.*, 1989, pp. 368-382.

Scarth et al., "Mercury high erucic low glucosinolate summer rape," *Can. J. Plant Sci.*, 1995, 75:205-206.

Uosukainen et al., "Transesterification of Trimethylolpropane and Rapeseed Oil Methyl Ester to Environmentally Acceptable Lubricants," *J. Am. Oil Chem. Soc.*, 1998, 75(11):1557-1563.

* cited by examiner

OILS WITH HETEROGENOUS CHAIN LENGTHS

CROSS-REFERENCE TO RELATED APPLICATIONS

This application is a divisional application of and claims priority to U.S. application Ser. No. 10/253,742, filed on Sep. 24, 2002, now U.S. Pat. No. 6,943,262, which is a continuation application of and claims priority to U.S. application Ser. No. 09/487,700, filed on Jan. 19, 2000, now U.S. Pat. No. 6,465,401, which is a continuation-in-part application of and claims priority to U.S. application Ser. No. 09/233,617, filed on Jan. 19, 1999, now U.S. Pat. No. 6,278,006, the entire contents of which are hereby incorporated by reference.

TECHNICAL FIELD

The invention relates to oils transesterified with short-chain fatty acid esters, and having improved lubrication properties.

BACKGROUND

Oils used in industrial applications are typically petroleum based hydrocarbons that can damage the environment, as well as pose health risks to people using them. Plant oils are an environmentally friendly alternative to petroleum based products, and are based on renewable natural resources. The major components of plant oils are triacylglycerols (TAGs), which contain three fatty acid chains esterified to a glycerol moiety. The polar glycerol regions and non-polar hydrocarbon regions of TAGs are thought to align at the boundaries of metal surfaces, and thus have better lubricant properties than petroleum hydrocarbons.

The low temperature properties and oxidative stability of plant oils, however, limit their use for industrial applications. Industrial oils must be liquid and have a reasonable viscosity at low temperatures. Most plant oils do not possess such low temperature properties. For example, high erucic rapeseed oil has a pour point (i.e., the temperature at which the oil ceases to flow) of −16° C., but undergoes a significant increase in viscosity with decreasing temperatures.

Industrial oils also must have high oxidative stability, which generally is related to the degree of unsaturation present in the fatty acyl chains. Reaction of a plant oil with oxygen can lead to polymerization and cross-linking of the fatty acyl chains, and decreased oxidative stability. Saturated hydrocarbon based oils have no unsaturation and therefore have high oxidative stability.

SUMMARY

The invention is based on transesterifying short saturated fatty acid esters with triacylglycerol containing oils, such as vegetable oils, to obtain oils having improved lubrication properties. Although vegetable oils are known to provide good boundary lubrication, their low oxidative stability and poor low temperature properties often prevent them from being utilized in lubrication applications. Transesterifying various short saturated fatty acid esters with a vegetable oil improves oxidative stability and low temperature properties due to the increased saturation and the heterogeneity of the fatty acids esterified to the polyols.

In one aspect, the invention features a method for improving lubrication properties of a vegetable oil. Lubrication properties can include wear properties, viscosity, or crystallization temperature. The method includes transesterifying the vegetable oil with a short chain fatty acid ester. The vegetable oil can have a monounsaturated fatty acid content of at least 50%, e.g., at least 70%, and can be selected, for example, from the group consisting of corn oil, rapeseed oil, soybean oil, and sunflower oil. Canola oil is a particularly useful rapeseed oil. The short chain fatty acid ester can be saturated, and can be from four to 10 carbons in length. In particular, the short chain fatty acid ester can be from six to 10 carbons in length. The short chain fatty acid ester can be normal or branched, and can be a methyl ester or a polyol ester, such as a neopentyl glycol ester, a pentaerythritol ester, or a trimethylolpropane ester. Trimethylolpropane triheptanoate is a useful trimethylolpropane ester.

The method further can include adding an amount of an antioxidant effective to increase oxidative stability of the transesterified vegetable oil. The antioxidant can be selected from the group consisting of hindered phenols, dithiophosphates, and sulfurized polyalkenes. The amount of antioxidant can be about 0.001% to about 10% by weight.

The invention also features an oil comprising a glycerol polyol ester and methods for making such oils. Oils of the invention further can include an antioxidant, an antiwear additive, a pour-point depressant, an antirust additive, or an antifoam additive. The glycerol polyol ester of such oils is characterized by the formula:

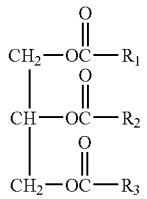

wherein R1, R2, and R3 are independently aliphatic hydrocarbyl moieties having three to 23 carbon atoms, wherein at least one of R1, R2, and R3 have a saturated aliphatic hydrocarbyl moiety having three to nine carbon atoms, and wherein at least one of R1, R2, and R3 have an aliphatic hydrocarbyl moiety having 11 to 23 carbon atoms. The saturated aliphatic hydrocarbyl moiety can be, for example, a hexyl moiety, a heptyl moiety, or a nonyl moiety. The aliphatic hydrocarbyl moiety having 11 to 23 atoms can be derived from oleic acid, eicosenoic acid, or erucic acid.

Oils of the invention further can have a non-glycerol polyol ester. The non-glycerol polyol ester can be characterized by the formula:

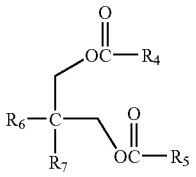

wherein R4 and R5 are independently aliphatic hydrocarbyl moieties having three to 23 carbon atoms, wherein at least one of R4 and R5 have a saturated aliphatic hydrocarbyl moiety having three to nine carbon atoms, and wherein at least one of R4 and R5 have an aliphatic hydrocarbyl moiety having 11 to 23 carbon atoms, wherein R6 and R7 are independently a hydrogen, an aliphatic hydrocarbyl moiety having one to four carbon atoms, or

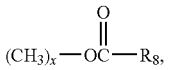

wherein X is an integer of 0 to 6, and wherein R8 is an aliphatic hydrocarbyl moiety having three to 23 carbon atoms. For example, R6 can be an ethyl moiety, and R7 can be

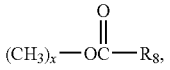

wherein X is 1 and R8 is an aliphatic hydrocarbyl moiety having three to 23 carbon atoms.

In an alternative embodiment, the invention features an oil that includes a non-glycerol polyol ester. The non-glycerol polyol ester is characterized by the formula:

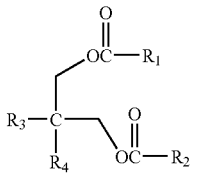

wherein R1 and R2 are independently aliphatic hydrocarbyl moieties having three to 23 carbon atoms, wherein at least one of R1 and R2 have a saturated aliphatic hydrocarbyl moiety having three to nine carbon atoms, and wherein at least one of R1 and R2 have an aliphatic hydrocarbyl moiety having 11 to 23 carbon atoms, wherein R3 and R4 are independently a hydrogen, an aliphatic hydrocarbyl having one to four carbon atoms, or

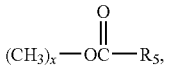

wherein X is an integer of 0 to 6, and R5 is an aliphatic hydrocarbyl moiety having three to 23 carbon atoms.

Unless otherwise defined, all technical and scientific terms used herein have the same meaning as commonly understood by one of ordinary skill in the art to which this invention belongs. Although methods and materials similar or equivalent to those described herein can be used to practice the invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

Figure 1:
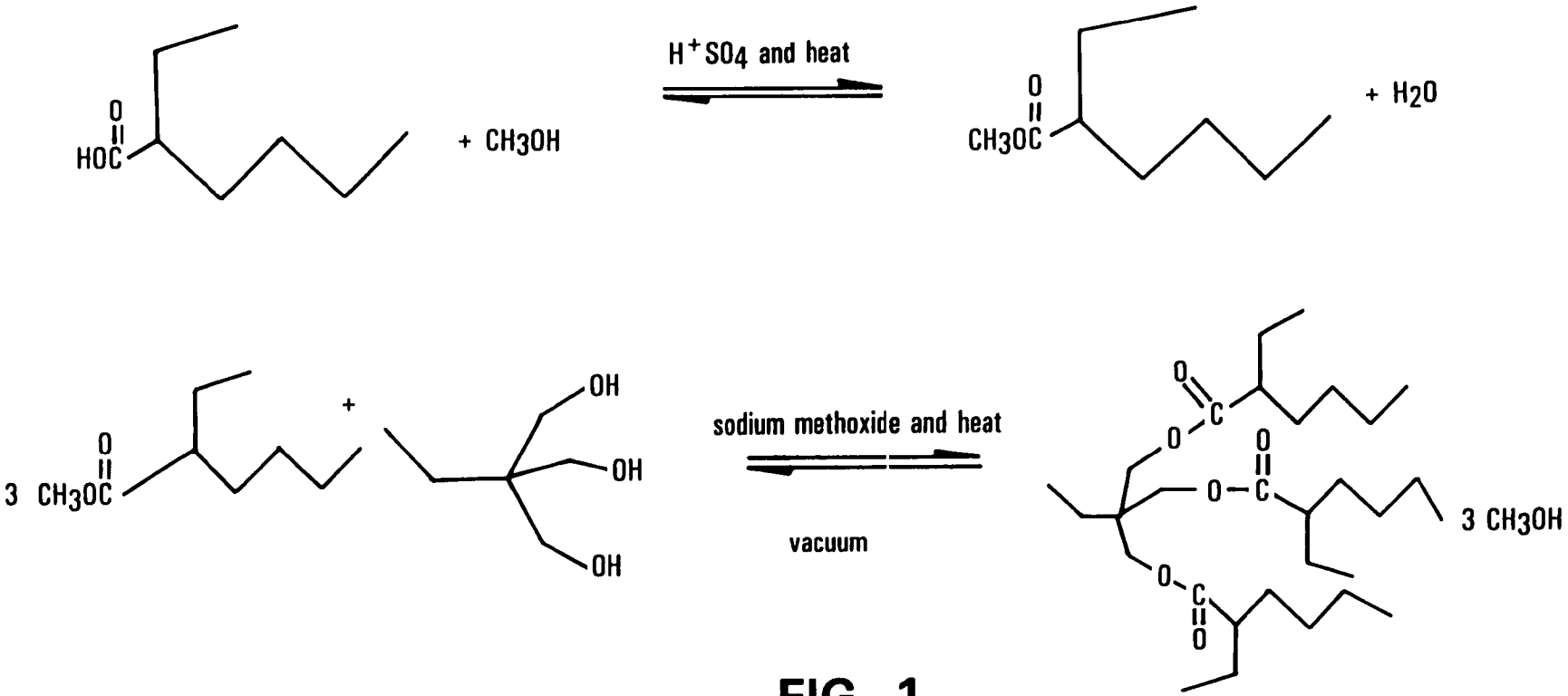
FIG. 1 is a diagram that depicts the synthesis of the methyl ester of 2-ethyl hexanoic acid (A) and the synthesis of TMP-esters (B).

Transesterification of two polyol esters randomizes the distribution of fatty acids among the polyol backbones, resulting in the transesterified products having properties different from each of the original polyol esters. As described herein, transesterifying a TAG containing oil, such as a vegetable oil, with a short chain fatty acid ester improves lubrication properties of the TAG containing oil. As used herein, "lubrication properties" refers to low temperature properties such as viscosity and crystallization temperature, and wear properties, such as low wear and reduced friction of the oil. Transesterified reaction products have the potential for increased oxidative stability due to an increased saturated fatty acid content and improved low temperature properties due to the heterogeneity of the fatty acid chains. A statistically significant improvement in lubrication properties is observed in comparison to a corresponding non-modified oil. Standard statistical tests can be used to determine if a lubrication property is significantly improved.

Starting Oils

Suitable starting oils contain TAGs, and can be synthetic or derived from a plant or an animal. For example, TAGs such as triolein, trieicosenoin, or trierucin can be used as starting materials. TAGs are available commercially, for example, from Sigma Chemical Company (St. Louis, Mo.), or can be synthesized using standard techniques. Plant derived oils, i.e., vegetable oils, are particularly useful starting materials, as they allow oils of the invention to be produced in a cost-effective manner. Suitable vegetable oils have a monounsaturated fatty acid content of at least about 50%, based on total fatty acid content, and include, for example, rapeseed (*Brassica*), sunflower (*Helianthus*), soybean (*Glycine max*), corn (*Zea mays*), crambe (*Crambe*), and meadowfoam (*Limnanthes*) oil. Canola oil, which has less than 2% erucic acid, is a useful rapeseed oil. Additional oils such as palm or peanut oil that can be modified to have a high monounsaturated content also are suitable. Oils having a monounsaturated fatty acid content of at least 70% are particularly useful. The monounsaturated fatty acid content can be composed of, for example, oleic acid (C18:1), eicosenoic acid (C20:1), erucic acid (C22:1), or combinations thereof Oils having an oleic acid content of about 70% to about 90% are particularly useful. For example, IMC-130 canola oil, available from Cargill, Inc., has an oleic acid content of about 75%, and a polyunsaturated fatty acid content (C18:2 and C18:3) of about 14%. U.S. Pat. No. 5,767,338 describes plants and seeds of IMC 130. See also U.S. Pat. No. 5,861, 187. High oleic sunflower oils having oleic acid contents, for example, of about 77% to about 81%, or about 86% to about 92%, can be obtained from A. C. Humko, Memphis, Tenn. U.S. Pat. No. 4,627,192 describes high oleic acid sunflower oils.

Oils having a high eicosenoic acid content include meadowfoam oil. Typically, meadowfoam oil has an eicosenoic acid content of about 60% to about 65%. Such oil is sold by the Fanning Corporation under the trade name "Fancor Meadowfoam".

Oils having a high erucic acid content include high erucic acid rapeseed (HEAR) oil, and crambe oil. HEAR oil has an erucic acid content of about 45% to about 55%, and is commercially available, for example, from CanAmera Foods (Saskatoon, Canada). For example, a high erucic acid rapeseed line that is sold under the trade name Hero is useful. Other high erucic acid varieties such as Venus, Mercury, Neptune or S89-3673 have erucic acid contents of about 50% or greater and also can be used. McVetty, P. B. E. et al., *Can. J. Plant Sci.,* 76(2):341-342 (1996); Scarth, R. et al., *Can. J. Plant Sci.,* 75(1):205-206 (1995); and McVetty, P. B. E. et al., *Can. J. Plant Sci.,* 76(2):343-344 (1996). Crambe oil has an erucic acid content of about 50% to about 55%, and is available from AgGrow Oils LLC, Carrington, N.D.

Transesterification

According to the invention, transesterification (i.e., the exchange of an acyl group of one ester with that of another ester) of a vegetable oil with an ester of a short chain fatty acid results in random esterification of the short chain fatty acids to the glycerol backbone of the vegetable oil, generating TAGs having the following structure:

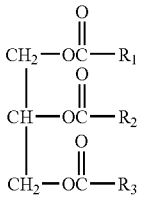

In this structure, R1, R2, and R3 are independently aliphatic hydrocarbyl moieties having about three to about 23 carbon atoms inclusive, wherein at least one of R1, R2, and R3 have a saturated aliphatic hydrocarbyl moiety having three to nine carbon atoms inclusive, and wherein at least one of R1, R2, and R3 have an aliphatic hydrocarbyl moiety having from 11 to 23 carbon atoms inclusive. As used herein, "hydrocarbyl moiety" refers to aliphatic alkyl and alkenyl groups, including all isomers, normal and branched. Suitable saturated aliphatic hydrocarbyl moieties include butyl, pentyl, hexyl, heptyl, octyl, nonyl, and decyl groups. Alkenyl moieties can have a single double bond such as heptadecenyl, or can have two or three double bonds such as heptadecadienyl and heptadecatrienyl.

Esters of short chain fatty acids include methyl esters and polyol esters. Methyl esters can be produced, for example, by esterification of fatty acids. Typically, the fatty acids are converted to methyl esters with methanol in an acid or base catalyzed reaction. Alternatively, methyl esters are available commercially and can be purchased, for example, from Sigma Chemical Company, St. Louis, Mo., or from Proctor and Gamble, New Milford, Conn. Transesterification of a vegetable oil with short chain methyl esters results in TAG esters of long and short chains. The byproducts of the reaction, methyl esters of long and short chain fatty acids, can be removed, for example, by vacuum distillation.

Polyol esters also can be used in the transesterification of vegetable oils. As used herein, "polyol esters" refers to esters produced from polyols containing from two to about 10 carbon atoms and from two to six hydroxyl groups. Preferably, the polyols contain two to four hydroxyl moieties. Non-limiting examples of polyols include 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, neopentyl glycol, 2,2,4-trimethyl-1,3-pentanediol, trimethylolpropane (TMP), and pentaerythritol. Neopentyl glycol, TMP, and pentaerythritol are particularly useful polyols. Polyol esters are produced by transesterification of a polyol with methyl esters of short chain fatty acids. As used herein, "short chain fatty acid" refers to all isomers of saturated fatty acids having chains of four to ten carbons, including fatty acids containing odd or even numbers of carbon atoms. Short chain fatty acids can include alkyl groups. For example, 2-ethyl hexanoic acid is a useful short chain fatty acid. Suitable TMP esters can include, for example, TMP tri(2-ethyl hexanoate), TMP triheptanoate (TMPTH), TMP tricaprylate, TMP tricaproate, and TMP tri(isononanoate).

Transesterification of a polyol ester with a vegetable oil results in the short fatty acid chains of the polyol, and the long fatty acid chains of the TAG, being randomly distributed among both the polyol and glycerol backbones. In one embodiment, oils of the invention contain TAGs having a structure as defined above, and a non-glycerol polyol ester having the following structure:

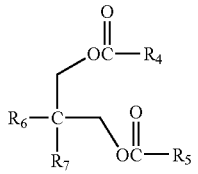

wherein R4 and R5 are independently aliphatic hydrocarbyl moieties having three to 23 carbon atoms inclusive, wherein at least one of R4 and R5 have a saturated aliphatic hydrocarbyl moiety, and wherein at least one of R4 and R5 have an aliphatic hydrocarbyl moiety having from 11 to 23 carbon atoms. R6 and R7 are independently hydrogen, an aliphatic hydrocarbyl having one to four carbon atoms, or

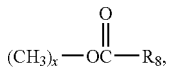

X is an integer of 0 to 6. R8 is an aliphatic hydrocarbyl moiety having three to 23 carbon atoms. In particular embodiments, R6 is an ethyl moiety, and R7 is

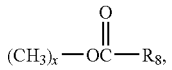

wherein X is 1 and R8 is an aliphatic hydrocarbyl moiety having three to 23 carbon atoms. In an alternative embodiment, the oil contains a non-glycerol polyol ester in the absence of a glycerol based polyol ester. Such oils can be produced by transesterifying the non-glycerol polyol with a long chain methyl ester or esterifying the non-glycerol polyol to a long chain fatty acid.

In general, transesterification can be performed by adding at least one short chain fatty acid ester to a vegetable oil in the presence of a suitable catalyst and heating the mixture. Typically, the vegetable oil comprises about 5% to about 90% of the reaction mixture by weight. For example, the vegetable oil can be about 10% to about 90%, about 40% to about 90%, or about 60% to about 90% of the mixture. As described herein, short chain fatty acid esters can be about 10% to about 95% of the reaction mixture by weight, and in particular, about 15% to about 30% of the reaction mixture. For example, the short chain fatty acid esters can be about 20% to about 25% of the reaction mixture. Ratios of vegetable oil:short chain fatty acid ester of about 80:20, about 75:25, or about 70:30 yield a high number of TAGs containing a single short chain, and also modify a majority of the TAGs in the vegetable oil.

Non-limiting examples of catalysts include base catalysts, sodium methoxide, acid catalysts including inorganic acids such as sulfuric acid and acidified clays, organic acids such as methane sulfonic acid, benzenesulfonic acid, and toluenesulfonic acid, and acidic resins such as Amberlyst 15. Metals such as sodium and magnesium, and metal hydrides also are useful catalysts. Progress of the reaction can be monitored using standard techniques such as high performance liquid chromatography (HPLC), infrared spectrometry, thin layer chromatography (TLC), Raman spectroscopy, or UV absorption. Upon completion of the reaction, sodium methoxide catalyst can be neutralized, for example, by addition of water or aqueous ammonium chloride. Acid catalysts can be neutralized by a base such as a sodium bicarbonate solution. Deactivated catalyst and soaps can be removed by a water wash, followed by centrifugation. The oil can be dried by addition of anhydrous magnesium sulfate or sodium sulfate. Remaining water can be removed by heating to about 40° C. to about 90° C., e.g., about 60° C., under vacuum. Methyl esters can be removed by distillation.

Characterization of Transesterified Oils

As described herein, transesterification of short chain fatty acids esters with vegetable oils improves the low temperature lubrication properties of the vegetable oils. Low temperature properties that are of interest include crystallization temperature, enthalpy of melting, and viscosity. Crystallization temperature and general melting behavior of the transesterification product can be assessed using differential scanning calorimetry (DSC).

Viscosity of an oil of the invention can be assessed by determining the viscosity index, an arbitrary number that indicates the resistance of a lubricant to viscosity change with temperature. The viscosity index can be readily measured using the American Society for Testing and Materials (ASTM) standard method D2270-91. The viscosity index can also be calculated from observed kinematic viscosities of a lubricant at 40° C. and 100° C. Kinematic viscosity values can be determined by Test Methods D445, IP 71, or ISO 3104.

Viscosity index values typically range from 0 to greater than 200. A higher viscosity index indicates that the oil changes less with a change in temperature. In other words, the higher the viscosity index, the greater the resistance of the lubricant to thicken at low temperatures and thin out at high temperatures. As described herein, viscosities of transesterified products were lower at low temperatures (−5° C.) than a commercial lubricant and IMC 130 canola oil, and similar to commercial lubricants at 40° C. and 100° C. Lower viscosity at low temperatures is a particularly useful property. Viscosity indices ranged from about 190 to about 255 for oils of the invention, which is a desirable range for lubrication applications. For example, transesterification of IMC 130 with TMPTH produced an oil having a viscosity index greater than 200.

Another property of interest is the oxidative stability of an oil. Oxidative stability is related to the degree of unsaturation in the oil, and can be measured, e.g. with an Oxidative Stability Index instrument, Omnion, Inc., Rockland, Mass. according to AOCS Official Method Cd 12b-92 (revised 1993). Oxidative stability is often expressed in terms of "AOM hours". The higher the AOM hours, the greater the oxidative stability of the oil. Oxidative stability also can be assessed by determining the oxidation induction time, a period of time that oxidation rate accelerates to a maximum. Oxidation induction time can be measured according to ASTM D6196-98 with pressure differential scanning calorimetry.

When an oil of the invention is made by transesterifying a vegetable oil, the oxidative stability of the transesterified oil is greater than that of the starting vegetable oil, when both are formulated to have the same level of antioxidants. Further improvement in oxidative stability of such a transesterified oil can be expected when loss of tocopherols present in the starting vegetable oil are minimized during the reaction and, in addition, with antioxidant formulation.

Other useful properties of an oil of the invention include lubrication properties and wear characteristics. Coefficients of friction and anti-wear properties can be assessed, for example, by a Four-Ball Wear test or a Micro-Four-Ball wear test. See, Asadauskas, S. et al., *J. Soc. Tribologists Lubrication Engineers,* 52(12):877-882 (1995). A microoxidation test can also be used to evaluate deposits or volatiles formed by a lubricant. For example, a thin-film oxidation test such as the Klaus Penn State Microoxidation Test can be used, which measures evaporation and deposits after about 2-3 hours at about 190° C. See, Cvitkovic, E. et al., *ASLE Transactions,* 22(4):395-401.

Vegetable oils transesterified with TMP esters of 2-ethyl hexanoic acid, isononanoic acid, and heptanoic acid have lower coefficients of friction and better anti-wear properties than the starting vegetable oil or a formulated commercial lubricant, indicating transesterification with short fatty acid chains enhances the lubricity of the starting oil.

Oil Formulations

Oils of the invention can be formulated with one or more additives and used as cost effective, high performance, and readily biodegradable industrial oils, such as high performance hydraulic fluids or engine lubricants. Typically, additives are present in lubrication compositions in amounts totaling from about 0.001% to about 20% based on weight. For example, a transmission fluid for diesel engines can be made that includes antioxidants, anti-foam additives, anti-wear additives, corrosion inhibitors, dispersants, detergents, and acid neutralizers, or combinations thereof. Hydraulic oil formulations an include antioxidants, anti-rust additives, anti-wear additives, pour point depressants, viscosity-index improvers and anti-foam additives or combinations thereof. Specific oil formulations will vary depending on the end use of the oil; suitability of a specific formulation for a particular use can be assessed using standard techniques. In addition, base oils, such as hydrocarbon mineral oils can be added.

Typical antioxidants are aromatic amines, phenols, compounds containing sulfur or selenium, dithiophosphates, sulfurized polyalkenes, and tocopherols. In addition, suitable antioxidants include heterocyclic compounds containing sulfur, nitrogen, and oxygen. For example, thiazoles, benzothiazoles, triazoles, and benzoxazoles compounds are suitable heterocyclic antioxidants. Hindered phenols are particularly useful, and include for example, 2,6-di-tert-butyl-p-cresol (DBPC), tert-butyl hydroquinone (TBHQ), cyclohexylphenol, and p-phenylphenol. Dovernox (Dover Chemical, Dover, Ohio) is a phenol type of antioxidant that is useful. Examples of amine-type antioxidants include phenyl-α-napthylamine, alkylated dephenylamines and unsymmetrical diphenylhydrazine. Irganox (Ciba Specialty Chemical, Tarrytown, N.Y.) is an amine type of antioxidant that is useful. Zinc dithiophosphates, metal dithiocarbamates, phenol sulfides, metal phenol sulfides, metal salicylates, phospho-sulfurized fats and olefins, sulfurized olefins, sulfurized fats and fat derivatives, sulfurized paraffins, sulfurized carboxylic acids, disalieylal-1,2,-propane diamine, 2,4-bis (alkyldithio)-1,3,4-thiadiazoles) and dilauryl selenide are examples of useful antioxidants. Lubrizol product #121056F (Wickliffe, Ohio) provides a mixture of antioxidants that is particularly useful. Antioxidants are typically present in amounts from about 0.001 to about 10 weight %. In particular embodiments, about 0.01% to about 3.0% of an antioxidant is added to an oil of the invention. For example, about 0.1% to about 0.4% of an amine type of antioxidant and about 0.5% to about 0.9% of a phenolic type of antioxidant can be added. See U.S. Pat. Nos. 5,451,334 and 5,773,391 for a description of additional antioxidants.

Rust inhibitors protect surfaces against rust and include alkylsuccinic type organic acids and derivatives thereof, alkylthioacetic acids and derivatives thereof, organic amines, organic phosphates, polyhydric alcohols, and sodium and calcium sulphonates. Anti-wear additives adsorb on metal, and provide a film that reduces metal-to-metal contact. In general, anti-wear additives include zinc dialkyldithiophosphates, tricresyl phosphate, didodecyl phosphite, sulfurized sperm oil, sulfurized terpenes and zinc dialkyldithiocarbamate, and are used in amounts from about 0.05 to about 4.5 weight %.

Corrosion inhibitors include dithiophosphates and in particular, zinc dithiophosphates, metal sulfonates, metal phenate sulfides, fatty acids, acid phosphate esters and alkyl succinic acids.

Pour point depressants permit flow of the oil formulation below the pour point of the unmodified lubricant. Common pour point depressants include polymethacrylates, wax alkylated naphthalene polymers, wax alkylated phenol polymers and chlorinated polymers, and generally are present in amounts of about 1% or less. In some embodiments, pour point depressants are present in amounts >1%. For example, pour point depressants can be present at amounts of about 6% or less (e.g., 0.01% to about 6%, 0.2% to about 5%, 0.2% to about 4%, 0.5% to about 5%, 0.5% to about 3%, or about 1% to about 2%). Suitable amounts of pour point depressants can be determined by standard methodology, such as determining fluidity of the lubricant at low temperatures. See, for example, U.S. Pat. Nos. 5,451,334 and 5,413,725.

Viscosity index can be increased by adding viscosity modifiers such as polyisobutylenes, polymethacrylates, polyacrylates, vinyl acetates, ethylene propylene copolymers, styrene isoprene copolymers, styrene butadiene copolymers, or styrene maleic ester copolymers.

Anti-foam additives reduce or prevent the formation of a stable surface foam and are typically present in amounts from about 0.00003 to about 0.05 weight %. Polymethylsiloxanes, polymethacrylates, salts of alkylene dithiophosphates, amyl acrylate telomer and poly(2-ethylhexylacrylate-co-ethyl acrylate are non-limiting examples of anti-foam additives.

Detergents and dispersants are polar materials that serve a cleaning function. Detergents include metal sulfonates, metal salicylates and metal thiophosponates. Dispersants include polyamine succinimides, hydroxy benzyl polyamines, polyamine succinamides, polyhydroxy succinic esters and polyamine amide imidazolines.

The invention will be further described in the following examples, which do not limit the scope of the invention described in the claims.

EXAMPLES

Example 1

Synthesis of Methyl Esters

Free fatty acids were converted into methyl esters via an acid catalyzed reaction of the free fatty acid and methanol. See FIG. 1A for a description of the synthetic route, using 2-ethyl hexanoic acid (Kyowa Hakko, New York, N.Y.) as an example. Approximately 100 g of fatty acid and 400 g of methanol were placed in a 1000 ml round bottom flask fitted with a reflux condenser. Twenty five g of concentrated sulfuric acid were slowly added to the mixture, which was then refluxed. Small samples (2-4 drops) were taken and applied to the surface of the infra-red spectrometer's ATR cell (Nicollet, Madison, Wis.). The methanol was evaporated using a stream of nitrogen and the IR spectrum was recorded. Reactions were considered complete when the samples did not produce further spectral changes, especially in the 3500-4000 cm-1 and 1400-1500 cm-1 regions. Typical reaction time was about 1.5 to about 2 hours.

Upon completion of the reaction, the mixture was allowed to cool to room temperature, and about 200 ml of water were added to the reaction mixture. Alternatively, after the reaction is complete, the methanol can be distilled off, and then extracted with hexane. After transfer to a 1000 ml separatory funnel, the reaction mixture was washed with about 400 ml of hexane. The hexane phase, which contains the methyl esters, was set aside after separation of the two phases. The methanol phase was extracted repeatedly with 200 ml of hexane until insignificant amounts of methyl esters were recovered (as determined by taking the IR spectrum of the hexane phase). Generally, a total of 5-6 extractions was performed.

The hexane phases were pooled together in a separatory funnel and washed with about 100 ml of 1% $KHCO_3$ (in water). The aqueous phase was removed, and the hexane phase was rewashed with about 100 ml of deionized water. The deionized water was removed from the separatory funnel and tested with pH paper. The water phase was neutral.

Traces of water were removed by pouring the hexane phase into a 1000 ml Erlenmeyer flask and adding 10 g of magnesium sulfate. After rapidly stirring for 5 minutes, the magnesium sulfate was removed by vacuum filtration. The hexane was evaporated using a rotovap and the methyl esters were weighed and their yield calculated. Yields were typically 90% or more.

Example 2

Synthesis of TMP-esters

A portion of the fatty acid methyl esters described in Example 1 were transesterified to TMP using the following procedure. FIG. 1B provides a schematic of the reaction.

One hundred g of a methyl ester from Example 1 were placed in a 250 ml round bottom flask. Trimethylolpropane (97%, Aldrich, Milwaukee, Wis.) was added in an amount such that the mole ratio of methyl ester groups to hydroxyl groups was about 1:0.75. The solution was heated to 80° C. under a constant stream of nitrogen, and 1 gram of sodium methoxide (30%, Acros, Pittsburgh, Pa.) in methanol was added (the methanol was not evaporated prior to addition). The reaction was monitored by taking the IR spectra of small samples and was judged complete when no further changes were observed in the spectrum (especially the hydroxyl region ~3500 cm-1).

After completion of the reaction, the mixture was allowed to cool down to room temperature. Catalyst was deactivated by addition of five grams of water and rapidly mixing for 30 seconds. Water and soaps were removed by centrifugation at 7000 rpm for 10 minutes. A second water washing was conducted, and the mixture stirred for 5 minutes. Centrifugation was again used to remove the water phase. The reaction mixture was poured into a clean 250 ml round bottom flask and heated to 100° C. under high vacuum to remove unreacted methyl esters. The material was then purified using silica gel (50 to 100 mesh, Aldrich, Milwaukee, Wis.) column chromatography.

Example 3

General Transesterification Procedure

Figure 2A:
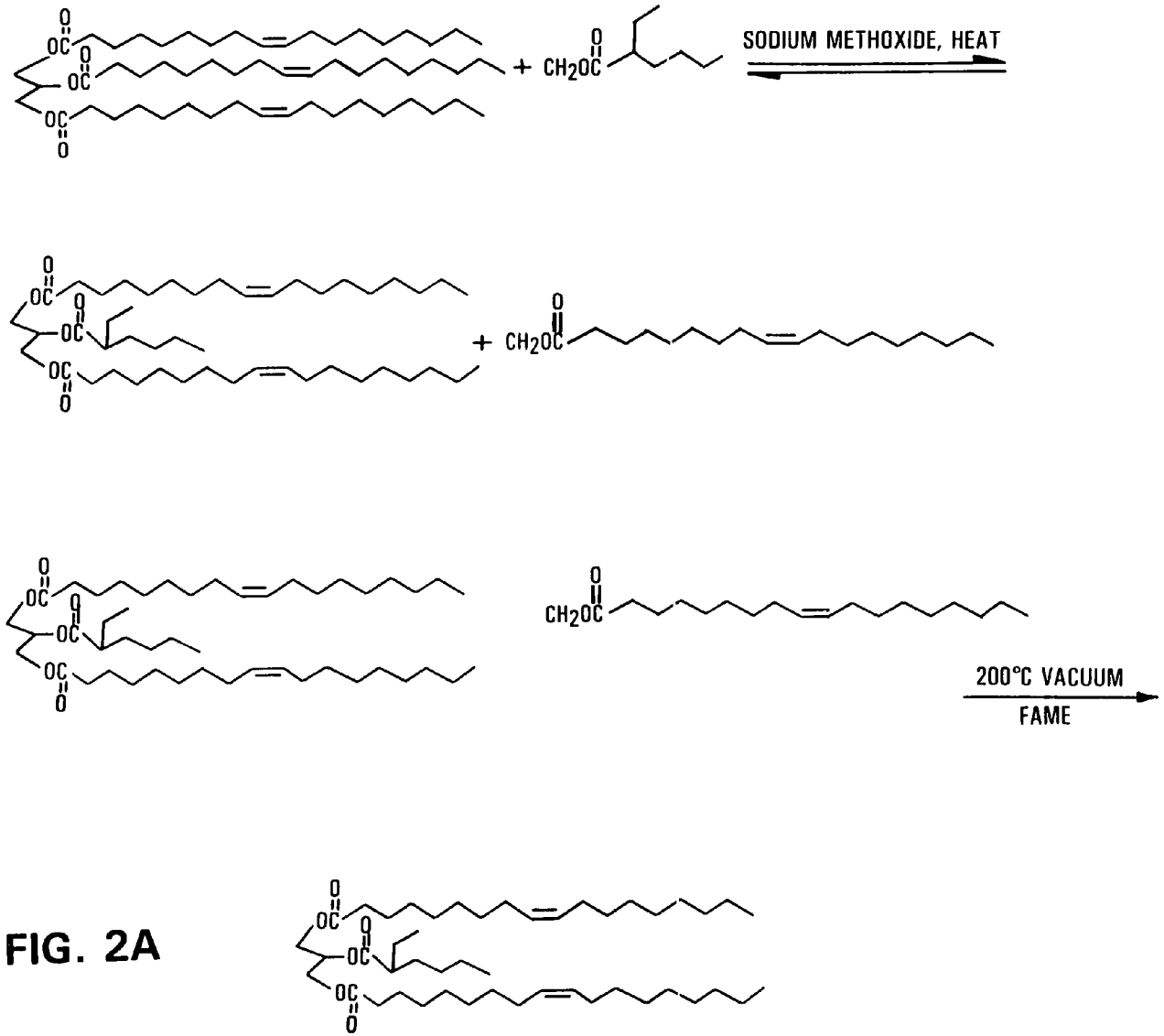
FIG. 2 is a diagram that depicts the transesterification of methyl esters (A) and TMT-esters (B) with IMC-130.
Figure 2B:
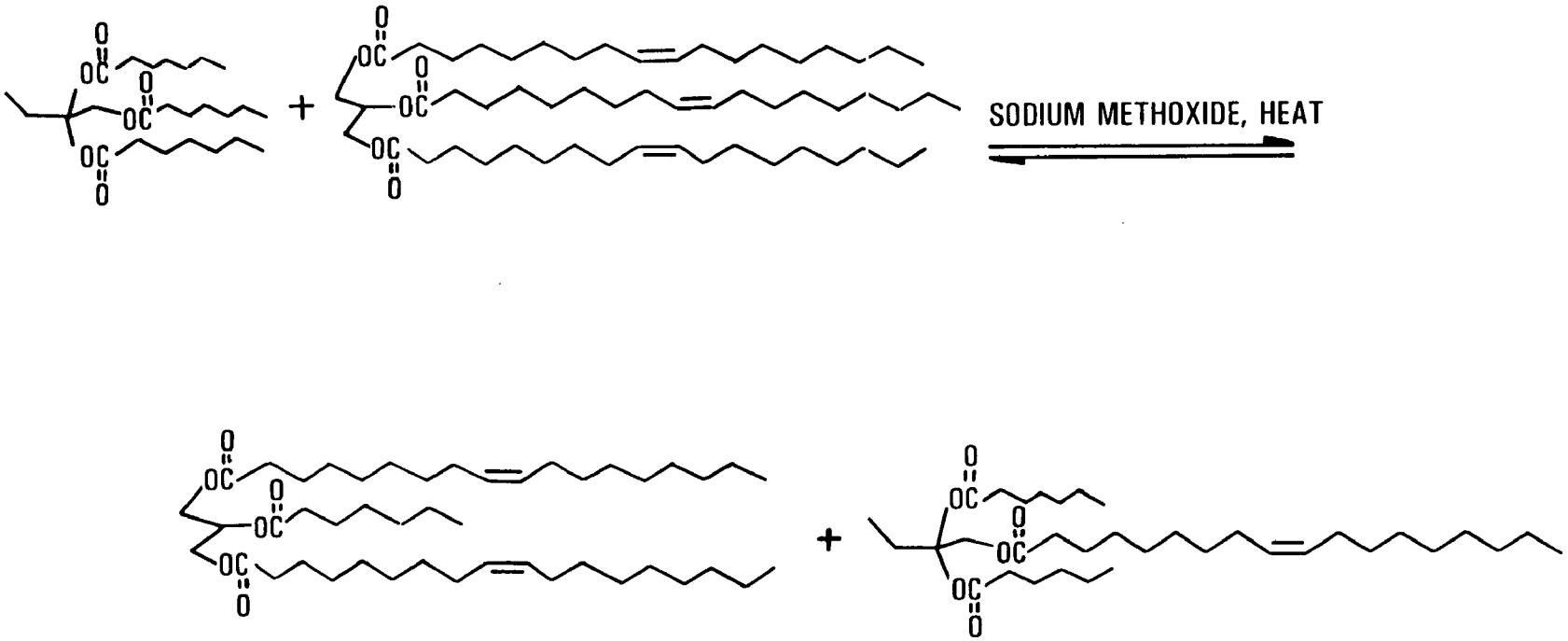

Short chain fatty acids, in the form of TMP or methyl esters, were transesterified with IMC-130 (Intermountain Canola, Idaho Falls, Id.) using the following procedure. FIG. 2 describes the transesterification of methyl esters (A) and TMP-esters (B) with IMC-130. It should be noted that when the short chain fatty acids were in the form of methyl esters, the long and short chain fatty acid methyl ester byproducts were removed by vacuum distillation after transesterification.

Approximately 80 g of IMC-130 were poured into a 250 ml round bottom flask. To prevent deactivation of the catalyst, the oil was heated to 100° C. under high vacuum to remove traces of moisture. Separately, one g of a 30% sodium methoxide solution (in methanol) was placed into a 20 ml scintillation vial and the methanol was evaporated using a stream of nitrogen gas. Care was taken not to overheat the catalyst, since this can result in decomposition and deactivation. The dried sodium methoxide was gently broken up into a fine powder with a metal spatula. Alternatively, powdered sodium methoxide is commercially available.

Twenty g of the short chain fatty acid ester (methyl or TMP ester) were added to the reaction flask along with the catalyst. If a TMP ester was being used, the temperature was increased to 100° C. under high vacuum. In the case of methyl esters, which were volatile under these conditions, a temperature of 80° C. with a nitrogen atmosphere was used.

After reaching 70°-80° C., the mixture darkened, indicating that transesterification had begun. The reaction was allowed to continue for an additional 30 minutes before being brought back to room temperature. Catalyst was neutralized by adding 5 g of water and stirring rapidly for 30 seconds. Deactivated catalyst and soaps that formed were removed by centrifugation at 7000 rpm for 10 minutes. The oil phase was decanted and washed with 5 g of water for 5 minutes, and then separated using the same centrifugation procedure.

Five g of anhydrous magnesium sulfate were added to the oil phase and rapidly stirred for 5 minutes, then removed by vacuum filtration. The trace amount of water that remained was removed by placing the oil in a flask and heating to 60° C. under high vacuum. If methyl esters were used in the transesterification, remaining methyl esters were removed by using a Kugel-Rohr short path distillation unit (Aldrich, Milwaukee, Wis.). The distillation procedure consisted of slowly heating the oil to 200° C. in a hot air bath, maintaining this temperature for 20 minutes, and collecting the fatty acid methyl esters in a distillate trap.

Example 4

Transesterification of Vegetable Oils with Short Chain Fatty Acid Esters

Figure 3:
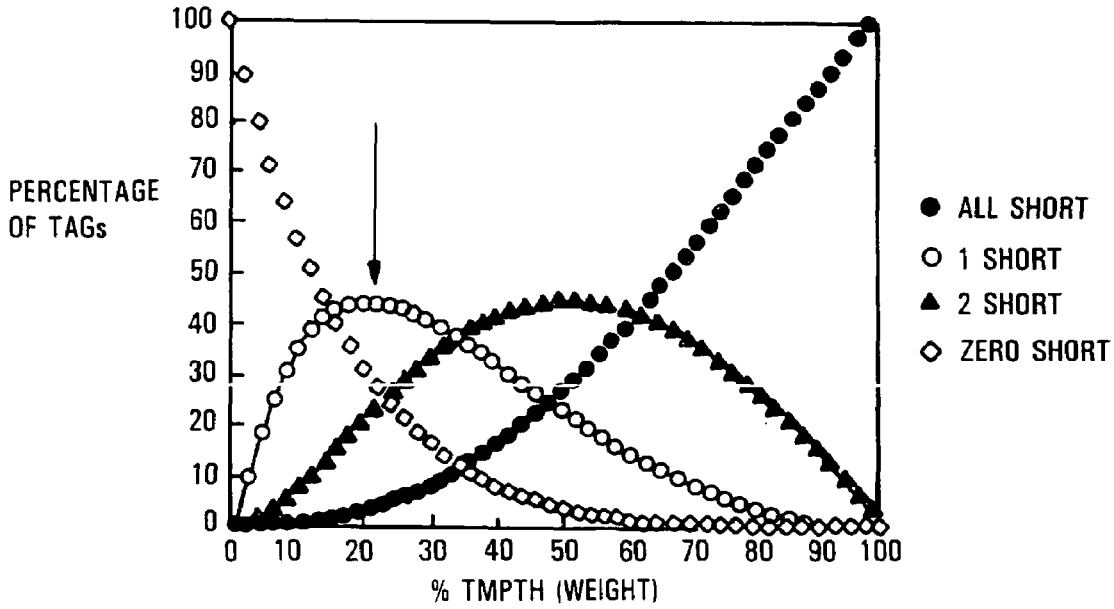
FIG. 3 is a graph of the predicted fatty acid distribution of the TAGs of TMPTH and IMC-130 transesterified products.

A statistical model based on a random distribution was developed to determine how the long chain fatty acids of IMC 130 oil TAGs and the short chain fatty acids of the non-glycerol ester would be distributed when short chain fatty acid esters were transesterified with IMC-130 oil at different concentrations. The model constructed for the transesterification of IMC-130 oil and TMPTH is shown in FIG. 3. Transesterifying about 20-25% TMPTH by weight with IMC-130 oil yields a large number of TAGs with one short chain, and modifies over 70% of the original TAGs found in IMC-130. Although models for short chain fatty acids other than TMPTH differed slightly due to differences in molecular weight, approximately 20-25 wt % yielded a high number of TAGs containing a single short chain, as well as modifying a majority of the TAGs in IMC 130. For this reason, transesterifications typically were done using about 20-25% by weight of the short chain fatty acids.

Several types of fatty acids, selected based on their availability, and their expected contribution to low temperature properties and fatty acid esters were obtained. Trimethylolpropane triheptanoate (TMPTH, Inolex, Pittsburgh, Pa., catalog #3I-310) has three fatty acid chains, each containing seven carbon atoms, esterified to TMP. Trimethyolpropane tricaprylate and caproate (TMPTC/c, Inolex, Pittsburgh, Pa., catalog #3N-310) consists of a TMP backbone esterified to fatty acids of eight or ten carbon atoms. C810 Methyl Esters (Proctor and Gamble, New Milford, Conn.) is a mixture of methyl esters of C8:0 and C10:0 fatty acids. C1098 Methyl Esters (Proctor and Gamble, New Milford, Conn.) consists of C10:0 fatty acid methyl esters. Methyl 2-ethyl hexanoate was made by esterifying 2-ethyl hexanoic acid to methanol. Methyl isononanoate was made by esterifying isononanoic acid (Kyowa Hakko, New York, N.Y.) to methanol. Trimethylolpropane tri(2-ethyl hexanoate) was made by transesterifying the corresponding fatty acid methyl ester to TMP. Trimethyolpropane tri(isononanoate) was made by transesterifying the corresponding fatty acid methyl ester to TMP. IMC-130 oil was transesterified with about 20 wt % short chain fatty acid esters. In one reaction, 25% TMPTH and 75% IMC-130 was used.

Transesterification reactions were monitored by HPLC. Reaction samples were washed with a small amount of water to stop the reaction. The water phase was removed by centrifugation, and the oil phase was dried with a small amount of magnesium sulfate. The samples were filtered through a small filter (Gelman Acrodisc, 0.45 μm) prior to being dissolved in solvent and injected onto the column. The mobile phase consisted of 40% acetonitrile (Fisher, Pittsburgh, Pa.) and 60% acetone, and was pumped (110B Solven Module, Beckman, Palo Altos, Calif.) through a Spherisorb RP-C18 column (Phase Separations, Norwalk, Conn.) at a rate of 1 ml/min. The column was maintained at 40° C. by a column heater (Biorad, Hercules, Calif.), and was monitored using a refractive index detector (Waters, Milford, Mass.) connected to a plotter/integrator (HP-3395 Hewlett-Packard, Santa Clarita, Calif.).

An experiment was conducted to determine the length of time required to achieve complete randomization of fatty acids during transesterification. In this experiment, the transesterification of TMPTH with IMC-130 was monitored by HPLC. A sample was taken of the physical mixture (IMC-130 and TMPTH without catalyst) prior to the start of the reaction.

The second sample was taken 5 minutes into the reaction, while the remaining samples were taken at 30 minute intervals.

Figure 4B:
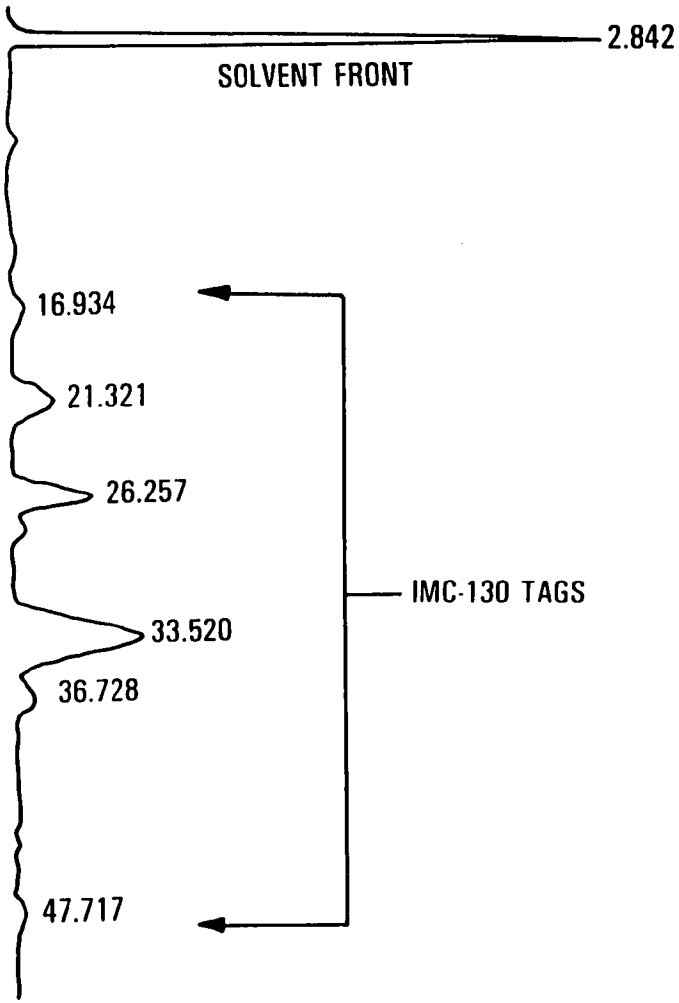
FIGS. 4A and 4B are HPLC chromatograms of TMPTH and IMC-130 triacylglycerol elution, respectively.
Figure 4A:
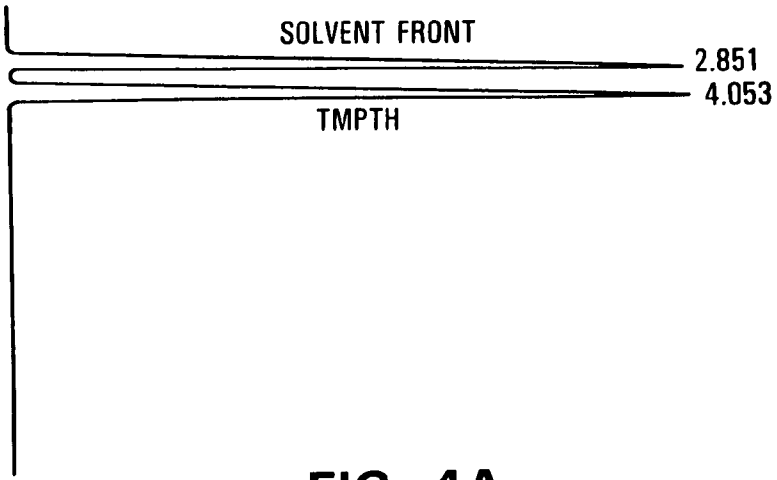
Figures 5A, 5B, 5C:
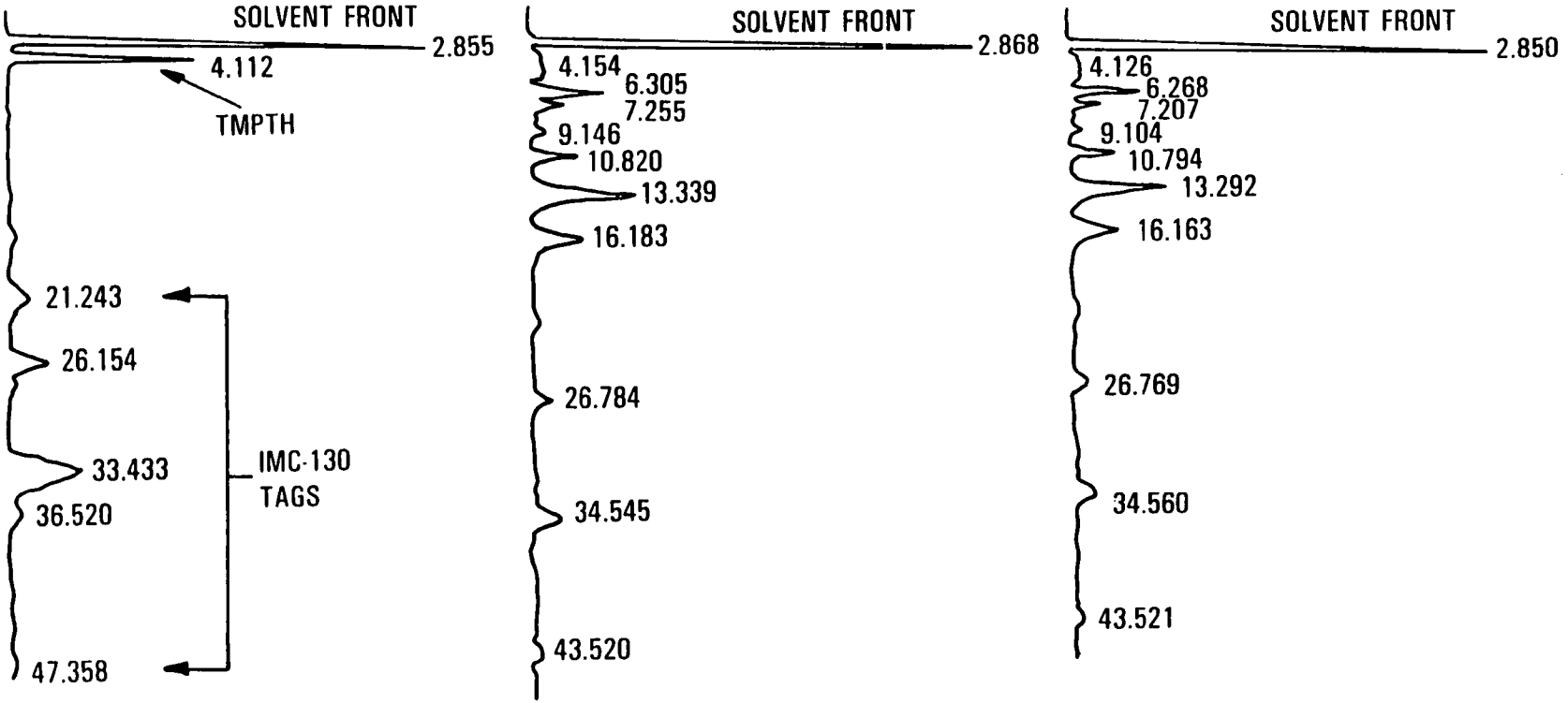
FIGS. 5A, 5B, and 5C are HPLC chromatograms of a transesterification reaction before addition of catalyst (5A), 5 minutes after initiation (5B), and 95 minutes after initiation (5C).

TMPTH eluted 4.1 minutes after being injected and produced only one peak, after the solvent front (see FIG. 4A). IMC-130 produced several peaks due to the presence of a wide range of TAGs, all having elution times greater than that of TMPTH (see FIG. 4B). As shown in FIG. 5, the chromatograms from the samples 5 minutes and 95 minutes after initiation of the transesterification reaction (FIGS. 5B and 5C) were identical, indicating the reaction was complete and randomization had been achieved in about 5 minutes. From the HPLC experiments, it was estimated that a reaction time of about 5 minutes was required to achieve complete randomization, although 30 minutes was used to ensure complete randomization.

Reverse phase thin layer chromatography (TLC) also was used to verify that transesterification had occurred. Glacial acetic acid was used as an eluent and the plate was developed by charring with sulfuric acid. All transesterified products produced the same general pattern of three spots. Spot 3 was closest to the origin, and was produced from triacylpolyols having three long fatty acid chains. The second spot was from triacylpolyols having two long and one short fatty acid chain. The first spot was furthest from the origin, and contained triacylpolyols having one long and two short fatty acid chains. It should be noted that spots with three short chains were not observed, since shorter fatty acids are less responsive to charring.

Example 5

Characterization of Transesterified Oil Products

Oxidative stability was measured as Active Oxygen Method (AOM) hours using the Oxidative Stability Index Official method (OSI) Cd 12b-92. Tocopherols were measured using the AOCS official method Ce 7-87.

Low temperature properties were evaluated with differential scanning calorimetry (DSC), using a Perkin-Elmer (Norwalk, Conn.) differential scanning calorimeter, Model 7. Samples were held at 20° C. for 1 minute, then heated to 75° C. at a rate of 40° C./minute. Samples were held at 75° C. for 10 minutes, then cooled to −40° C. at 1° C./minute. After holding at −40° C. for 20 minutes, samples were heated to 75° C. at 1° C./minute.

Oxidative stability and low temperature properties of transesterified (TE) oils are shown in Table 1. The ratio of oil to short chain fatty acid ester was 80:20 in each of these samples, unless noted otherwise.

TABLE 1

Oxidative Stability and Low Temperature Properties of Transesterified Oils

| Material | Tocopherol[2] | Oxidative Stability[1] NoAdded Antioxidants | +3% Lubrizol[3] | +1% TBHQ | Cryst. Temp ° C. | MP° C. |
|---|---|---|---|---|---|---|
| TMPTO (commercial lubricant) | 0.000 | <1 | 113.00 | 221.57 | −60 | −40 |
| TMPTH (commercial lubricant) | 0.000 | 17.9 | 63.58 | 464 | −60 | −20 |
| IMC-130 starting oil | 0.060 | 38.0 | 51.70 | 382.00 | −36 | −6.6 |
| IMC-130/TMPTH (TE) | 0.034 | 17.90 | 63.58 | 464.00 | −60 | −20 |
| IMC-130/TMPTH (TE) 75:25 | 0.034 | not done | not done | not done | −60 | −20 |
| IMC-130/TMPTC/c (TE) | 0.025 | 8.70 | 70.24 | 537.00 | −32 | −10 |
| IMC-130/C8 Methyl Ester (TE) | 0.038 | 29.32 | 121.00 | 500+ | −30 | −6 |
| IMC-130/C10 Methyl Ester (TE) | 0.025 | 10.50 | 67.48 | 500+ | −20 | −4 |
| IMC-130/Methyl 2-ethyl hexanoate (TE) | — | 5.57 | 50.52 | — | −32 | 2 |
| IMC-130/Methyl isononanoate (TE) | — | 8.00 | 53.76 | — | −38 | 2 |
| IMC-130/TMP ester 2-ethyl hexanoate (TE) | — | 14.15 | 63.00 | 300+ | −38 | −3.9 |
| IMC-130/TMP ester Isononanoate (TE) | — | 15.14 | 67.60 | 161.00 | −40 | −4.7 |

[1]AOM hours
[2]Tocopherol amount in material (%)
[3]Lubrizol #121056F added at 3% by weight The oxidative stabilities of the transesterified products without added antioxidants were lower than the starting oil, which is thought to be due to the loss of tocopherols from the canola oil during production of the transesterified products. In fact, AOM stabilities of the transesterified products correlated to their tocopherol concentration. Addition of antioxidants to the transesterified oils brought the oxidative stabilities above those of IMC-130 fortified with a similar amount of antioxidant (Table 1). This indicates that the transesterified products are more responsive to antioxidants than vegetable oils. Further improvement in oxidative stability of the transesterified oils can be expected when tocopherol loss is minimized. It is contemplated that routine modification of reaction conditions will minimize tocopherol loss.

Figure 6:
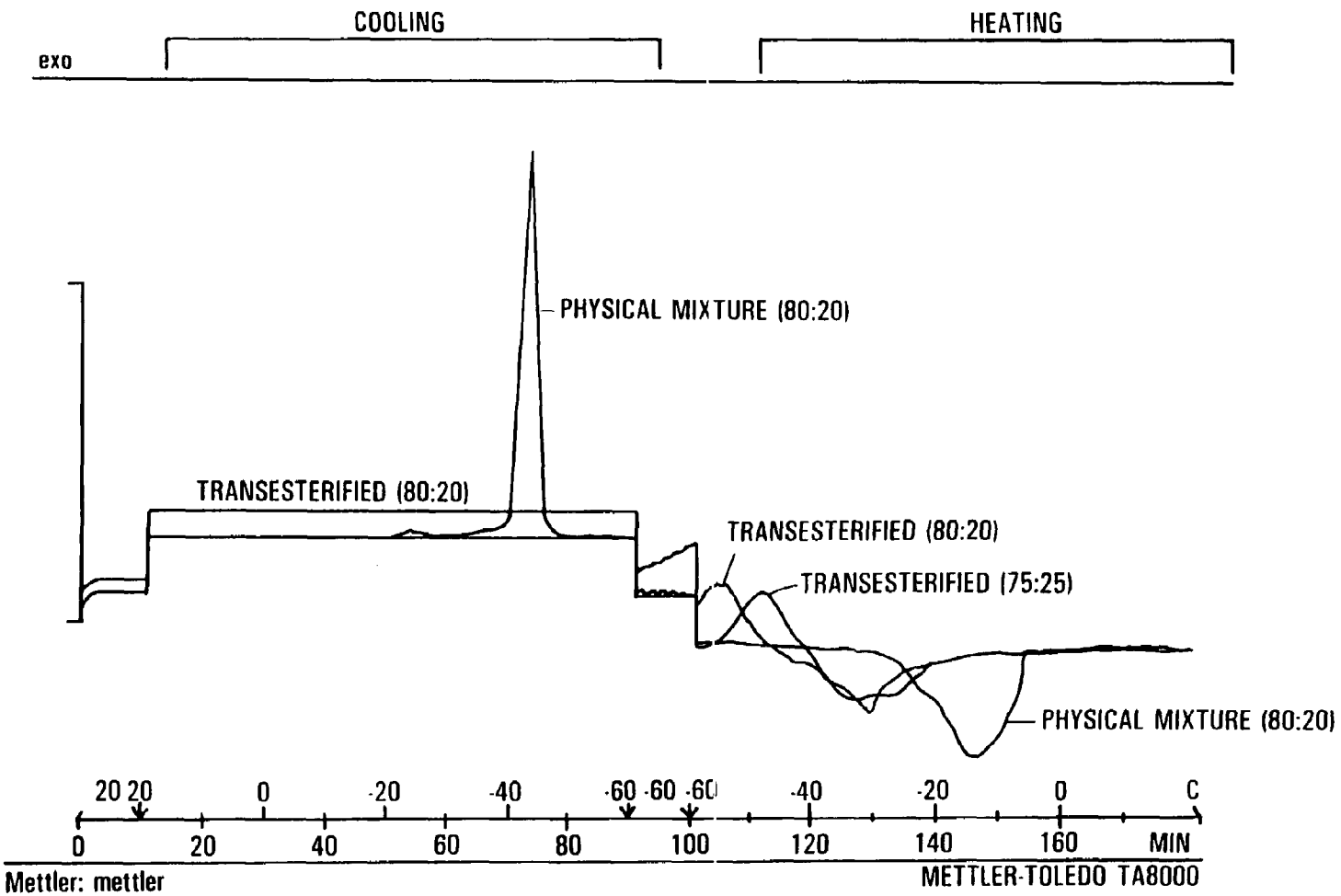
FIG. 6 is a DSC profile of IMC-TMPTH before and after transesterification.

The low temperature properties indicate that, in most cases, transesterification produced improvements in the vegetable oil. Transesterification with TMPTH was notable since it significantly lowered the crystallization melting temperatures of the transesterified oil products as compared with the starting vegetable oil. The DSC profile of the IMC/TMPTH mixture before and after transesterification is shown in FIG. 6.

Viscosity profiles, as a function of temperature, were obtained using a Brookfield viscometer with a small sample adapter. A circulating water bath containing ethylene glycol and water (1:1) was connected to the adapter's jacket to control the temperature of the sample. The sample was cooled to −5° C. and allowed to equilibrate at this temperature for 2-3 minutes. Once equilibrated, the viscosity was recorded. The temperature was increased 5° C. and the process of temperature equilibration and viscosity measurement was repeated every 5° C. until a temperature of 100° C. was reached. Viscosity Index was calculated using ASTM official method D2270.

Differences in viscosity were most easily detected at low temperatures. As temperatures were increased, the viscosities of all the transesterified products become similar to IMC-130. The viscosities (cP) and viscosity indices of the transesterified (TE) oils are given in Table 2.

TABLE 2

Viscosities (cP) of Transesterified Products

| Product | Viscosity at 5° C. | Viscosity at 40° C. | Viscosity at 100° C. | Viscosity Index |
|---|---|---|---|---|
| TMPTO (commercial lubricant) | 440 | 46.1 | 9.3 | 193 |
| TMPTH | — | 14 | 3.4 | 122 |
| IMC-130 only | 330 | 39.5 | 8.3 | 205 |
| IMC-130/TMPTH (TE) 80:20 | 253 | 30.2 | 7.56 | 242 |
| IMC-130/TMPTH 75:25 | 230 | 30 | 7.1 | 220 |
| IMC-130/TMPTC/c (TE) | 260 | 33.6 | 7.3 | 197 |
| IMC-130/C8 Methyl Ester (TE) | 221 | 29 | 6.6 | 203 |
| IMC-130/C10 Methyl Ester (TE) | 265 | 32 | 7 | 198 |
| IMC-130/Methyl 2-ethyl hexanoate (TE) | 434 | 37.4 | 8.3 | 213 |
| IMC-130/Methyl isononanoate (TE) | 335 | 38 | 8 | 204 |
| IMC-130/TMP ester 2-ethyl hexanoate (TE) | 236 | 29.1 | 6.4 | 195 |
| IMC-130/TMP ester Isononanoate | 266 | 32.1 | 7.05 | 203 |

In addition, micro four-ball tests, which measure friction and wear were conducted. In the micro-four-ball tests at either 10 or 40 kg load, a 30 minute pre-conditioning segment was performed using a 10 ml white oil sample. At the end of this interval, the ball pot was cleaned without moving the balls, and the scar diameters measured. At these loads, wear scars of 0.40±0.02.mm at 10 kg, and 0.50±0.02 mm at 40 kg should be obtained. If the scars did not fall within these limits, the test was voided. This process results in common starting surface area and load.

For the 30 minute test segment, a 6 μl sample of each test oil was carefully added to the scar area of the top (chuck) ball using a hypodermic syringe. The balls were carefully brought in contact with no load, and rotated slightly by hand to distribute the liquid sample. The load then was applied, and the test continued for an additional 30 minutes. All tests were run twice and the average value reported. The test temperature in all tests was 75° C.

Lubrication tests indicated that transesterifying IMC-130 with short chain fatty acids improves both the coefficient of friction (f) and the anti-wear properties (ΔScar). The Δ scar value of mineral oil is usually about 0.2 mm and the coefficient of friction is usually about 0.07. A coefficient of friction less than 0.05 is considered very good. The results for the transesterified products are given in Table 3.

TABLE 3

Mini-four-Ball Test Results

| Sample | ΔScar[1] (mm) | Coefficient of Friction (f) |
|---|---|---|
| Commercial Lubricant[2] | 0.07 | 0.052 |
| IMC-130 | 0.07 | 0.050 |
| IMC-130/TMPTH | 0.06 | 0.043 |

TABLE 3-continued

Mini-four-Ball Test Results

| Sample | ΔScar[1] (mm) | Coefficient of Friction (f) |
|---|---|---|
| IMC-130/TMP-2 Ethyl Hexanoic | 0.04 | 0.038 |
| IMC-130/TMP-Isononanoic | 0.07 | 0.41 |

[1]Results obtained using the micro-4 ball test 40 kg, 75 C., 30 min
[2]The commercial ester lubricant is formulated, all other samples are not Oxidation stability of the fluids was evaluated using the Klaus Penn State Micro-Oxidation Test (PSMO), which measure formation of oxidized deposits and volatiles. The test is a thin-film oxidation test involving only 20 μl of test fluid. The initial tests were conducted at 190° C. for a period of 3 hours. The test conditions were essentially equivalent to 0.5 hours at 225° C., which is used to screen engine oils for IIID engine tests. Under these conditions, a non-additive containing white oil would exhibit about 25% evaporation and 10% deposit.

To demonstrate the effect of time and temperature in these tests, samples were run in the PSMO at three different conditions (2 hours at 190° C., 1 hour at 200° C. and 0.5 hours at 225° C.). The 200° C. and 225° C. conditions are not as severe as the 190° C. conditions. Based on the results of these three conditions, testing of formulated oils at 190° C. for 2 hours provides a more rigorous assessment of their stability under lubricating conditions.

Results from a PSMO test are described in Table 4. Samples that have lower % volatiles and lower % deposits have a higher resistance towards oxidation. As can be seen in Table 3, transesterified products performed as well as the starting vegetable oils.

TABLE 4

PSMO Oxidation Tests Results

| Sample | % Volatiles[2] | % Deposits[2] |
|---|---|---|
| Commercial Lubricant[3] | 18.6 | 60.9 |
| IMC-130 | 27.4 | 69.8 |
| IMC/TMPTH | 21.8 | 73.2 |
| IMC/TMP-2 Ethyl Hexanoic | 23 | 74.6 |
| IMC/TMP-2 Ethyl Hexanoic | 23 | 74.6 |

[2]Results obtained during the Klaus Penn State Micro-oxidation (PSMO) test @ 190° C. for 3 hours
[3]The commercial ester lubricant is formulated with antioxidants. All other samples contain no additives

Example 6

Preparation and Characterization of Transesterified Soy and Sunflower Products The procedure described in Example 3 was used to make transesterified products with vegetable oils having an oleic acid content that was higher than IMC-130. IMC 93-GS, which has an oleic acid content of 84.5%, was obtained from Intermountain Canola, Cargill, Inc. High oleic sunflower oil (HO-SFO, Intermountain Canola, Cargill, Inc.) and high oleic soybean oil (HO-SBO, Optimum Quality Grains, L.L.C., West Des Moines, Iowa) have oleic acid contents of 81% and 83%, respectively. Table 5 provides the ratio of vegetable oil to TMPTH used to make the transesterified reaction products, as well as the oxidative stability of the products without antioxidants (as is) and with 0.75% TBHQ or 3% Lubrizol. Table 5 also provides results from pressure differential scanning calorimetry (PDSC), which were obtained using standard method ASTM D 6186-98. PDSC was performed on samples without additives at 130° C. or with an antioxidant mixture containing 0.75% Dovernox (Dover Chemical, Dover, Ohio) and 0.25% Irganox (Ciba Specialty Chemical, Tarry Town, N.Y.) at 160° C. Dovernox is a phenolic type of antioxidant and Irganox is an amine type of antioxidant. Results are presented as oxidative induction time in Table 5.

As indicated in Table 5, vegetable oils that had a high oleic acid content yielded transesterified products with high oxidative stabilities. In comparison, unmodified vegetable oils have lower oxidative stabilities that the transesterified products (Table 5). For example, IMC-130 has an oxidative stability of 34 AOM hours, IMC 93-GS has an oxidative stability of 66 AOM hours, and high oleic acid soybean oil has an oxidative stability of 100 AOM hours. The induction time for TMPTH could not be measured due to baseline drift.

TABLE 5

Characterization of Transesterified Products

| Vegetable Oil Used | Veg Oil: TMPTH | AOM (as is) | AOM (0.75% TBHQ) | AOM (3.0% Lubrizol) | PDSC (As is) 130° C. | PDSC With AO Mix 160° C. |
|---|---|---|---|---|---|---|
| IMC 93-GS | 75:25 | 75.96 | — | 109.25 | — | — |
| IMC-130 | 75:25 | — | 444 | 82.38 | — | — |
| IMC-130 | 70:30 | 40 | — | — | 12 min | 35 min |
| HO-SBO | 70:30 | 195 | 433 | — | — | — |
| HO-SFO | 70:30 | — | — | — | 17 min | 60 min |

| Starting Materials | AOM (as is) | PDSC (As is) 160° C. | PDSC With AO Mix 160° C. |
|---|---|---|---|
| IMC-93-GS | 66 | 8.0 min | |
| IMC-130 | 34 | 6.5 min | 36 min |
| HO-SFO | | 6.16 min | 57 min |
| HO-SBO | 100 | 12.0 min | 52 min |

Example 7

Characterization of Transesterified Product Made with Varying IMC-130 and TMPTH Ratios Transesterified product was produced according to Example 3, with ratios of IMC-130 to TMPTH of 70:30, 73:27, 75:25, and 80:20. DSC was performed on the transesterified products to determine melting point (° C.) and the enthalpy of melting (ΔH melting, j/g). A Perkin Elmer differential scanning calorimeter was used. Samples were cooled from room temperature to 40° C. at 1° C./minute, held at −40° C. for 20 minutes then heated from −40° C. to 75° C. at 1° C./minute. As indicated in Table 6, increasing the TMPTH content in the transesterification reaction produced a material with a lower melting point and a lower enthalpy of melting.

TABLE 6

Melting Point and Enthalpy of Melting of Transesterified Product

| IMC130:TMPTH | ΔH melting j/g | Melting Point ° C. |
|---|---|---|
| 100:0 | 69.0 | −6 |
| 80:20 | 36.9 | −9.8 |
| 75:25 | 22.2 | −10.4 |
| 73:27 | 17.8 | −11.9 |
| 70:30 | 13.3 | −12.2 |

Example 8

Formulating Transesterified Products with Viscosity Modifiers

Viscosity modifiers were added to a transesterified product that was made according to Example 3, using a 73:27 ratio of IMC-130 to TMPTH. Viscosity modifiers, including V-508 (Functional Products, Mecadonia, Ohio), Erucichem T6000 (Erucichem Division of ILI, Seattle, Wash.), and Lubrizol product #105648F (Wickliffe, Ohio) were added at concentrations ranging from about 0.2% to about 5%. Table 7 provides the viscosity (cP) at 40° C. or at 37.8° C. (100° F.). Addition of Lubrizol Product No. 105648F provided the largest increase in viscosity.

TABLE 7

Viscosity of Transesterified Products with Viscosity Modifiers

| Modifier | Concentration | Viscosity @ 40° C. (cP) |
|---|---|---|
| Functional Products | 0.0% | 25.8 |
| V-508 | 0.5% | 26.3 |
| | 2.0% | 30.5 |
| | 5.0% | 41.0 |
| Lubrizol 105648F | 0.0% | 25.8 |
| | 0.2% | 26.5 |
| | 2.0% | 73.5 |

| Modifier | Concentration | Viscosity @ 37.8° C. (cP) |
|---|---|---|
| Erucichem T6000 | 0.0% | 27.2 |
| | 0.5% | 28.2 |
| | 1.5% | 28.6 |
| | 2.0% | 29.5 |
| | 5.0% | 33.7 |
| Lubrizol 105648F | 0.2% | 31.3 |
| | 0.5% | 37.3 |
| | 0.75% | 44.5 |
| | 1.0% | 50.0 |

Example 9

Formulating Transesterified Products with Pour Point Depressants

In general, a specified amount of lubricant (prepared as described in Example 3, 73:27 ratio of IMC-130:TMPTH) and pour point depressant were weighed in 20 ml scintillation vials, and the contents were stirred magnetically until the materials were thoroughly mixed. Vials were placed into an upright laboratory freezer, where the temperature was kept at approximately −25° C. Observations were made approximately every two days. The performance of three different pour point depressants was compared. Lubrizol Product Nos. 143850, 134894A, and 146533 (Wickliffe, Ohio) were used. Table 8 contains a summary of the observations. In comparison, IMC 130 gels within 2 hours at this temperature.

TABLE 8

Fluidity of Formulated Transesterified Products

| Pour Point Depressant | Concentration | Remained fluid after 1 month? |
|---|---|---|
| Lubrizol 143850 | 1.0% | Yes |
| | 2.0% | Yes |
| | 5.0% | Yes |
| Lubrizol 134894A | 1.0% | Yes |
| | 2.0% | Yes |
| | 5.0% | Yes |
| Lubrizol 146533 | 0.5% | Yes |
| | 0.75% | Yes |
| | 1.0% | Yes |

Lubrizol Product No. 143850 also was used to formulate transesterified products produced from an 80:20 and 75:25 ratio of IMC-130:TMPTH. As indicated in Table 9, transesterified product made from a 75:25 ratio of IMC-130:TMPTH and formulated with Lubrizol Product No. 143850 performs better than lubricant made with an 80:20 ratio of IMC-130:TMPTH and formulated with the same pour point depressant.

TABLE 9

Fluidity of Formulated Transesterified Product

| Ratio IMC-130:TMPTH | Level | Results |
|---|---|---|
| 75:25 | 1% | Gelled in ~1 week |
| 75:25 | 2% | Remain fluid >1 month |
| 80:20 | 1% | Gelled with in a day |
| 80:20 | 2% | Gelled within 3 days |
| 75:25 | — | Gelled with in a day |
| 80:20 | — | Gelled with in a day |

Performance of transesterified product formulated with Lubrizol Product No. 143850 was compared with Kielflow pour point depressants (Ferro Corporation, Hammond, Ind.) 195 and 150. Transesterified product that was used was produced with a 70:30 ratio of IMC-130 to TMPTH. A new chest-type freezer that produced less temperature variability than the freezer used above was used to hold the material for 1 month. As indicated in Table 10, transesterified product formulated with 0.5-1.0% of Kielflow 195 or 150 or 1-2% of Lubrizol Product No. 143850 remained fluid after 1 month.

TABLE 10

Fluidity of Formulated Product

| Pour Point Depressant | Concentration | Remained fluid after 1 month? |
|---|---|---|
| Kielflow 195 | 0.5% | Yes |
| | 1.0% | Yes |
| | 2.0% | No - gelled within 2 days |
| | 5.0% | No - gelled within 2 days |
| Kielflow 150 | 0.5% | Yes |
| | 1.0% | Yes |
| | 2.0% | No - gelled within 2 days |
| | 5.0% | No - gelled within 2 days |
| Lubrizol 143850 | 0.5% | No - Gelled after 3 week |
| | 1.0% | Yes |
| | 2.0% | Yes |

Example 10

Formulating Transesterified Product with Antioxidants

Lubricant produced with a 70:30 ratio of IMC-130 to TMPTH was formulated with antioxidants. Performance of product formulated with Dovernox was compared with that formulated with TBHQ. Oxidative stability was measured as described in Example 5 and is reported as AOM hours in Table 11. Addition of Dovernox provided greater oxidative stability than TBHQ in this product (Table 11).

TABLE 11

Oxidative Stability of Formulated Product

| Antioxidant | Amount (wt %) | AOM Hours |
|---|---|---|
| TBHQ | 0.02 | 51.34 |
| | 0.02 | 51.46 |
| | 0.10 | 93.16 |
| | 0.10 | 82.74 |
| | 0.50 | 196.64 |
| | 0.49 | 108 |
| | 0.98 | 345.61 |
| | 0.98 | 314.84 |
| Dovernox | 0.02 | 62.75 |
| | 0.02 | 64.45 |
| | 0.10 | 117.26 |
| | 0.10 | 119.93 |
| | 0.50 | 432.83 |
| | 0.99 | 513.75 |
| No additive | — | 45 |
| | — | 38 |

Performance of a two-component antioxidant mixture also was assessed. Table 12 provides the percent of Dovernox and Irganox that was used to formulate the transesterified product. PDSC was used to assess performance and is reported as the oxidation induction time (min.).

TABLE 12

Oxidation induction Time of Formulated Product

| Dovernox | Irganox | PDSC minutes (@160° C.) |
|---|---|---|
| 0 | 0 | 2 |
| 0 | 0.25 | 10.581 |
| 0 | 0.5 | 13.125 |
| 0 | 0.75 | 14.26 |
| 0.25 | 0 | 14.21 |
| 0.25 | 0.25 | 29.17 |

TABLE 12-continued

| Oxidation induction Time of Formulated Product | | |
|---|---|---|
| Dovernox | Irganox | PDSC minutes (@160° C.) |
| 0.25 | 0.5 | 29.36 |
| 0.25 | 0.75 | 31.3 |
| 0.5 | 0 | 20.27 |
| 0.5 | 0.25 | 36.99 |
| 0.5 | 0.5 | 40.75 |
| 0.5 | 0.75 | 39.84 |
| 0.75 | 0 | 24.645 |
| 0.75 | 0.25 | 37.57 |
| 0.75 | 0.5 | 44.14 |
| 0.75 | 0.75 | 45 |

Addition of Irganox and Dovernox boosted the performance as measured by PDSC. Adding more than 0.25% Irganox provided diminishing improvements, whereas increasing the amount of Dovernox produced a steady increase in performance. Based on these results, it was determined that addition of about 0.25% Irganox and about 0.75% Dovernox provided maximal benefits.

Performance of phenothiazine (Aldrich Chemical Co., St. Louis, Mo.) was compared with the Dovernox-Irganox combination in transesterified product made from high oleic sunflower oil and TMPTH (70:30). In addition, Irganox was combined with phenothiazine to determine if there was benefit to the oxidative stability. PDSC was used to assess the formulated products. Results are indicated in Table 13 as the oxidation induction time.

TABLE 13

| Oxidative Induction Time (min) of Formulated Products (180° C., ASTM D 6186 98) | | | | |
|---|---|---|---|---|
| % antioxid. | Dovernox | Phenothiazine | Dovernox-Irganox (75:25) | Phenothiazine-Irganox (75:25) |
| 0.25 | 1.67 | 6.14 | 9.66 | 7.7 |
| 0.5 | 4.65 | 16.42 | 13.56 | 18.57 |
| 0.75 | 6.11 | 29.25 | 14.19 | 29.06 |
| 1 | 8.28 | 35.5 | 16.42 | 39.45 |
| 3 | | 81 | | |

Example 11

Optimization of Reaction Conditions

In this experiment, reaction time, reaction temperature, and catalyst concentration were varied. The reaction product obtained from the reaction using 0.3% sodium methoxide catalyst for three hours was considered to have "completely randomized" fatty acyl chains on the polyols. All other samples were compared to this completely randomized sample. Reactions were performed at 80° C. with 0.05%, 0.1%, or 0.3% catalyst and at 100° C. with 0.05%, 0.1%, and 0.3% catalyst. Samples were assessed using HPLC fitted with a Hewlett Packard ODS Hypersil column (5 μm particle size, 200×2.1 mm) and 40% acetonitrile, 60% acetone solvent at a flow rate of 1 ml/min. A Waters Differential Refractometer (Model R401) was used as the detector.

From these data, it was concluded that reactions performed at 100° C. were better than those performed at 80° C. In addition, at this temperature, catalyst concentrations of 0.3% and 0.1% were equivalent and both performed better than 0.05% catalyst.

Two methods for removing catalyst were assessed to determine, inter alia, if properties such as oxidative stability were affected. The first method includes water washing followed by centrifugation. The second method includes acidification followed by filtration. Five reactions were performed and each reaction was split into two parts. The first part was treated with enough 6M HCl to neutralize the base catalyst. The mixture was then filtered through a filter aid. The other half was treated with 5% water, rapidly stirred for 10 minutes using a magnetic stirrer then centrifuged at 5000 rpm for 15 minutes. A sample was taken for PDSC, and the water washing/centrifugation steps were repeated once more. The PDSC scans (130° C.) were performed in random order. Oxidative induction time is reported in Table 14. Analysis of variance indicated that two water washes resulted in higher oxidative stability, and that one water wash was statistically equivalent to the acid treated samples. In addition to increasing oxidative stability, the acid value (i.e., number of milligrams of potassium hydroxide needed to neutralize the free fatty acids in one gram of sample) also was significantly less when the water washing procedure was used. Typical acid values for water washed and acid treated samples are 0.02 and 0.7 respectively, as determined by AOCS Official method Cd 3d-63.

TABLE 14

| Onset of Oxidation | | | | |
|---|---|---|---|---|
| Reaction # | Treatment | Onset #1 | Onset #2 | Average |
| 1 | Water (1×) | 17.2 | 20.56 | 18.88 |
| 1 | Water (2×) | 29.64 | 29.31 | 29.475 |
| 1 | Acid | 20.47 | 21.13 | 20.8 |
| 2 | Water (1×) | 21.86 | 20.47 | 21.165 |
| 2 | Water (2×) | 32.47 | 30.43 | 31.45 |
| 2 | Acid | 21.54 | 22.4 | 21.97 |
| 3 | Water (1×) | 23.45 | 23.36 | 23.405 |
| 3 | Water (2×) | 22.07 | 25.83 | 23.95 |
| 3 | Acid | 19.96 | 20.56 | 20.26 |
| 4 | Water (1×) | 24.75 | 21.67 | 23.21 |
| 4 | Water (2×) | 23.08 | 24.1 | 23.59 |
| 4 | Acid | 23.23 | 20.41 | 21.82 |
| 5 | Water (1×) | 17.67 | 17.07 | 17.37 |
| 5 | Water (2×) | 28.82 | 29.92 | 29.37 |
| 5 | Acid | 21.04 | 19.44 | 20.24 |

Example 12

Determination of Anti-Wear Properties of a Formulated Transesterified Product Transesterified product (73:27 IMC-130:TMPTH) was formulated with 1.5% pour point depressant (Lubrizol Product No. 143850), 0.75% viscosity modifier (Lubrizol Product No. 105648F), and 0.75% TBHQ, and a four-ball test was performed according to ASTM D4172. Anti-wear additives were not added. The mean scar diameters were 0.651, 0.614, and 0.656 mm over three test runs, with a grand mean of 0.641 mm. These scar diameters indicate the material has good lubrication properties. Addition of anti-wear additives further can enhance the performance of the material.

Example 13

Characterization of Transesterified Product Made from High Oleic Sunflower Oil and TMPTH Product was produced as described in Example 6, using a 70:30 ratio of high oleic sunflower oil to TMPTH. Catalyst was neutralized by a water wash. Conductivity was assessed using a conductivity meter (Emcess Electronics, Venice, Fla.). Table 15 provides the conductivity (picosiemens/meter, ps/m) of the material. The slope was 0.23 ps/m/g.

TABLE 15

Conductivity of Transesterified Product

| Weight (g) | Conductivity (ps/m) |
|---|---|
| 4.0 | 1.01 |
| 6.1 | 1.48 |
| 8.2 | 1.97 |

Viscosity of the product was assessed at temperatures ranging from −5° C. to 100° C. and is indicated in Table 16 (cP). The viscosity index was calculated to be 196 for this product.

TABLE 16

Viscosity of Transesterified Product

| Temp ° C. | Viscosity (cp) |
|---|---|
| −5 | 255 |
| 0 | 201 |
| 5 | 142 |
| 10 | 108 |
| 15 | 83 |
| 20 | 66.5 |
| 25 | 54 |
| 30 | 44 |
| 35 | 35 |
| 40 | 30.8 |
| 45 | 26 |
| 50 | 22.4 |
| 55 | 19.4 |
| 60 | 17 |
| 65 | 14.2 |
| 70 | 12.5 |
| 75 | 11 |
| 80 | 9.89 |
| 85 | 8.88 |
| 90 | 8 |
| 95 | 7.32 |
| 100 | 6.7 |

The transesterified high oleic sunflower product also was formulated with 1% antioxidant (75:25 Dovernox:Irganox) and assessed for the parameters listed in Table 17.

TABLE 17

Characterization of Transesterified Product

| Parameter | Method | Result |
|---|---|---|
| Specific Gravity at 20° C. | ASTM D 1298 | 0.924 kg/l |
| Viscosity at 100° C. | ASTM D 445 | 6.33 $mm^2$/sec |
| Viscosity at 40° C. | ASTM D 445 | 27.19 $mm^2$/sec |
| Viscosity Index | ASTM D 2270 | 197 |
| Flash point closed cup | ASTM D 93 | 84.0° C. |
| Flash point open cup | ASTM D 93 | 247° C. |
| Fire Point | ASTM D 92 | 310° C. |
| Auto ignition | ASTM E 659 | 380° C. |
| Ash content | ASTM D 482 | 0.023% |
| Sulfur content | ASTM D 4047 | 72 ppm |
| Chlorine content | UOP 779 | 5 ppm |
| Nitrogen content | ASTM D 3931 | 101 ppm |
| Water Content | ASTM D 1744 | 143 ppm |
| Wear 4 balls 1 hour at 40 kg | ASTM D 4172 | 0.66 $mm^2$ |

Oxidation induction time was measured for the, sample as is and after addition of 0.75% Dovernox and 0.25% Irganox. The samples were measured twice. Without additives, oxidation induction times of 13.56 and 14.36 minutes were observed, whereas with antioxidants, oxidation induction times were 62 and 62.7 minutes.

Tocopherol content also was measured as described in Example 5. Total tocopherol content was 191 ppm, and was composed of 160 ppm alpha tocopherol, 11 ppm beta tocopherol, 17 ppm gamma tocopherol, and 4 ppm delta tocopherol.

Acid value was calculated to be 0.02 as described above. Moisture content also was assessed by the Karl-Fisher method. Water concentration was 189.5 ppm and 145.02 ppm for two samples.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A lubricant composition comprising a glycerol polyol ester and a non-glycerol polyol ester, wherein said glycerol polyol ester is at least 70% by weight of said lubricant composition and is characterized by the formula:

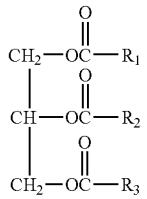

wherein R1, R2, and R3 are independently aliphatic hydrocarbyl moieties having three to 23 carbon atoms, wherein at least one of R1, R2, and R3 have a saturated aliphatic hydrocarbyl moiety having three to nine carbon atoms, and wherein at least one of R1, R2, and R3 have an aliphatic hydrocarbyl moiety having 11 to 23 carbon atoms.

2. The lubricant composition of claim 1, wherein said saturated aliphatic hydrocarbyl moiety having three to nine carbon atoms is a hexyl moiety.

3. The lubricant composition of claim 1, wherein said saturated aliphatic hydrocarbyl moiety having three to nine carbon atoms is a nonyl moiety.

4. The lubricant composition of claim 1, wherein said aliphatic hydrocarbyl moiety having 11 to 23 carbon atoms is derived from a fatty acid selected from the group consisting of oleic acid, eicosenoic acid, and erucic acid.

5. The lubricant composition of claim 1, said lubricant composition further comprising an antioxidant.

6. The lubricant composition of claim 1, said lubricant composition further comprising an antiwear additive.

7. The lubricant composition of claim 1, said lubricant composition further comprising a pour-point depressant.

8. The lubricant composition of claim 1, said lubricant composition further comprising an antirust additive.

9. The lubricant composition of claim 1, said lubricant composition further comprising an antifoam additive.

10. The lubricant composition of claim 1, wherein said glycerol polyol ester comprises about 80% to about 99.99% by weight of said lubricant composition.

11. A method of producing a transesterified oil comprising transesterifying a triacylglycerol containing oil with a non-glycerol polyol ester, to produce said transesterified oil, wherein said transesterified oil comprises a first glycerol polyol ester and a second non-glycerol polyol ester, said first polyol ester present in an amount of at least 70% by weight of said transesterified oil and characterized by the formula:

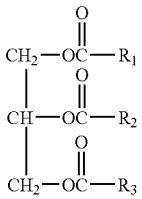

wherein R1, R2, and R3 are independently aliphatic hydrocarbyl moieties having three to 23 carbon atoms, wherein at least one of R1, R2, and R3 have a saturated aliphatic hydrocarbyl moiety having three to nine carbon atoms, and wherein at least one of R1, R2, and R3 have an aliphatic hydrocarbyl moiety having 11 to 23 carbon atoms.

12. A lubricant composition comprising a glycerol polyol ester and an additive selected from the group consisting of an antiwear additive, pour-point depressant, and antirust additive, wherein said glycerol polyol ester is at least 70% by weight of said lubricant composition and is characterized by the formula:

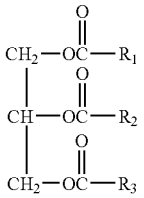

wherein R1, R2, and R3 are independently aliphatic hydrocarbyl moieties having three to 23 carbon atoms, wherein at least one of R1, R2, and R3 have a saturated aliphatic hydrocarbyl moiety having three to nine carbon atoms, and wherein at least one of R1, R2, and R3 have an aliphatic hydrocarbyl moiety having 11 to 23 carbon atoms.

* * * * *

UNITED STATES PATENT AND TRADEMARK OFFICE

CERTIFICATE OF CORRECTION

PATENT NO. : 7,514,394 B2
APPLICATION NO. : 11/072071
DATED : April 7, 2009
INVENTOR(S) : Dharma R. Kodali It is certified that error appears in the above-identified patent and that said Letters Patent is hereby corrected as shown below:

Column 2, lines 29-36, please delete the chemical structure and insert

-- 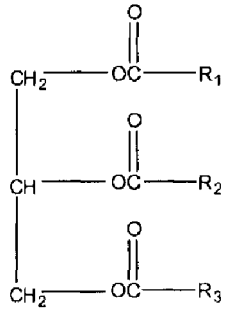 -- therefor;

Column 24, lines 28-35 (Claim 1), please delete the chemical structure and insert -- 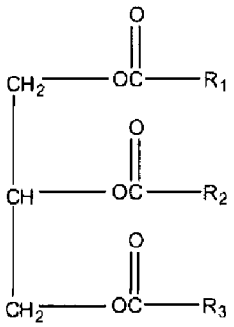 -- therefor;

Column 25, lines 10-17 (Claim 11), please delete the chemical structure and insert -- 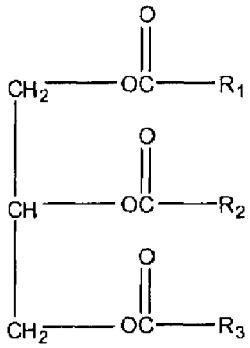 -- therefor;

UNITED STATES PATENT AND TRADEMARK OFFICE

CERTIFICATE OF CORRECTION

PATENT NO. : 7,514,394 B2
APPLICATION NO. : 11/072071
DATED : April 7, 2009
INVENTOR(S) : Dharma R. Kodali It is certified that error appears in the above-identified patent and that said Letters Patent is hereby corrected as shown below:

Column 26, lines 9-15 (Claim 12), please delete the chemical structure and insert -- 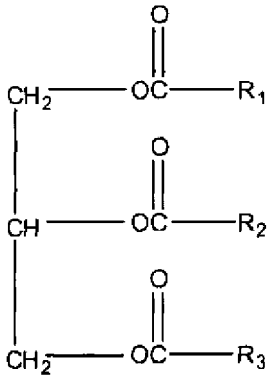 -- therefor.

Signed and Sealed this

Seventeenth Day of November, 2009

David J. Kappos

David J. Kappos
*Director of the United States Patent and Trademark Office*